US007378802B2

(12) United States Patent
Ichikawa et al.

(10) Patent No.: US 7,378,802 B2
(45) Date of Patent: May 27, 2008

(54) DISCHARGE LAMP LIGHTING CIRCUIT

(75) Inventors: Tomoyuki Ichikawa, Shizuoka (JP); Takao Muramatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 176 days.

(21) Appl. No.: 11/446,887

(22) Filed: Jun. 5, 2006

(65) Prior Publication Data

US 2006/0273736 A1 Dec. 7, 2006

(30) Foreign Application Priority Data

Jun. 6, 2005 (JP) ..... P.2005-165464

(51) Int. Cl.
*H05B 37/02* (2006.01)

(52) U.S. Cl. ..... 315/219; 315/274; 315/224; 315/279; 315/209 R

(58) Field of Classification Search ..... 315/219, 315/209 R, 224, 225, 213, 214, 274, 276–279, 315/282–287, 291, 307
See application file for complete search history.

(56) References Cited

U.S. PATENT DOCUMENTS 7,245,087 B2 * 7/2007 Nishikawa et al. ..... 315/224

FOREIGN PATENT DOCUMENTS

JP 11-135278 5/1999

* cited by examiner

*Primary Examiner*—Tuyet Vo
(74) *Attorney, Agent, or Firm*—Fish & Richardson P.C.

(57) ABSTRACT

A circuit includes a transformer 7 for transmitting power to a discharge lamp 10 and for supplying a starting signal to the discharge lamp. The circuit includes a direct current-alternating current converting circuit 3 for supplying an output of the transformer 7 to the discharge lamp 10 after carrying out a direct current-alternating current conversion, and a starting circuit 4 for applying the starting signal to the discharge lamp 10. A primary side of the transformer 7 has a first capacitor 11, a circuit portion 13 including a rectifying element, and a switching element 14. The transformer 7 has an auxiliary winding **7*v* for supplying a voltage for generating the starting signal to the starting circuit. A second capacitor 12 is interposed between the auxiliary winding and the circuit portion 13 and prevents absorption of energy by the capacitor 11** in generating the starting signal and prevents attenuation of the starting signal.

5 Claims, 6 Drawing Sheets

DISCHARGE LAMP LIGHTING CIRCUIT

TECHNICAL FIELD

The present disclosure relates to a discharge lamp lighting circuit in which attenuation of a starting signal by a capacitor (starter capacitor) is prevented.

BACKGROUND

A lighting circuit of a metal halide discharge lamp or the like is known for use in a vehicular illuminating light source. The lamp includes a direct current voltage booster circuit having a DC-DC converter, a direct current-alternating current converting circuit, and a starting circuit. For example, in one arrangement, the starting circuit includes a transformer whose primary side is provided with a capacitor (starter capacitor), and a self-break down type switching element of a spark gap or the like. The self-break down type switching element conducts when a terminal voltage exceeds a threshold by charging the capacitor. A starting pulse (or starter pulse) can be generated by causing a primary current flow in the transformer to be applied to the discharge lamp from a secondary winding of the transformer.

Some arrangements include a circuit for storing energy by charging the capacitor, which has an auxiliary winding for generating a high voltage at the transformer so as to supply a voltage from the auxiliary winding to a capacitor by way of a rectifying element of a diode or the like.

According to the foregoing circuit arrangement, a problem can arise by magnetically coupling a main winding (primary winding and secondary winding) of the transformer and the auxiliary winding for generating the high voltage through a core. In particular, when the high voltage pulse is generated at the primary winding of the transformer to start the discharge lamp, a surge voltage in accordance with the pulse generation also is generated at the auxiliary winding. When the energy is stored by the starter capacitor, the starting signal is attenuated and results in deterioration of the starting performance.

Hence, it would be desirable to guarantee starting performance of a discharge lamp lighting circuit without a significant increase in size and cost.

SUMMARY

As described below, a discharge lamp lighting circuit includes a transformer that transmits power to a discharge lamp and that supplies a starting signal to the discharge lamp. The circuit also includes a direct current-alternating current converting circuit for supplying an output of the transformer to the discharge lamp by receiving a direct current input voltage and converting the voltage into an alternating current voltage. A starting circuit is provided for applying the starting signal to the discharge lamp. Various implementations may include one or more of the following features.

A primary side of the transformer can include a first capacitor, a circuit portion including a rectifying element, and a switching element. When a terminal voltage of the first capacitor rises and the switching element is brought into a conductive state, a signal generated at a primary winding of the transformer is applied to the discharge lamp as the starting signal after having been boosted by the transformer The transformer can include an auxiliary winding for supplying a voltage necessary for generating the starting signal to the starting circuit. A second capacitor is interposed between the auxiliary winding and the circuit portion.

According to an implementation of the invention, the second capacitor prevents absorption of energy by the first capacitor in generating the starting signal. That is, the second capacitor prevents the starting signal from being attenuated by preventing a high voltage from being directly applied to the first capacitor in generating the starting signal.

Various implementations can include one or more of the following advantages. For example, a circuit arrangement that incorporates the transformer including a main winding and the auxiliary winding for generating a high voltage, proper starting of the discharge lamp can be guaranteed.

With regard to the first capacitor, when a double voltage rectifying circuit is formed by the first capacitor by connecting multiple capacitors in series and utilizing the respective capacitors, the arrangement is effective for reducing size and cost.

Further, by using an arrangement that supplies an alternating current voltage having a reference at a ground potential to the double voltage rectifying circuit and charging the first capacitor by transmitting an electric charge at respective time periods of a positive half wave and a negative half wave related to the alternating current voltage, the circuit can be simplified and have a low cost.

The auxiliary winding can be wound such that its polarity, causes a surge voltage induced in generating the starting signal, to become a negative potential. One end of the rectifying element forming the circuit portion is grounded, and the other end of the rectifying element is connected to the second capacitor. Regarding the surge voltage generated during the starting signal, a withstanding voltage of the second capacitor can be minimized and, therefore, the circuit arrangement can be made at lower cost.

It is preferable to use a laminated ceramic capacitor of a paraelectric material for the capacitor. For example, a capacitor having a low withstanding voltage and a large capacitance can be used.

DETAILED DESCRIPTION OF THE BEST MODE FOR CARRYING OUT THE INVENTION

Figure 1:
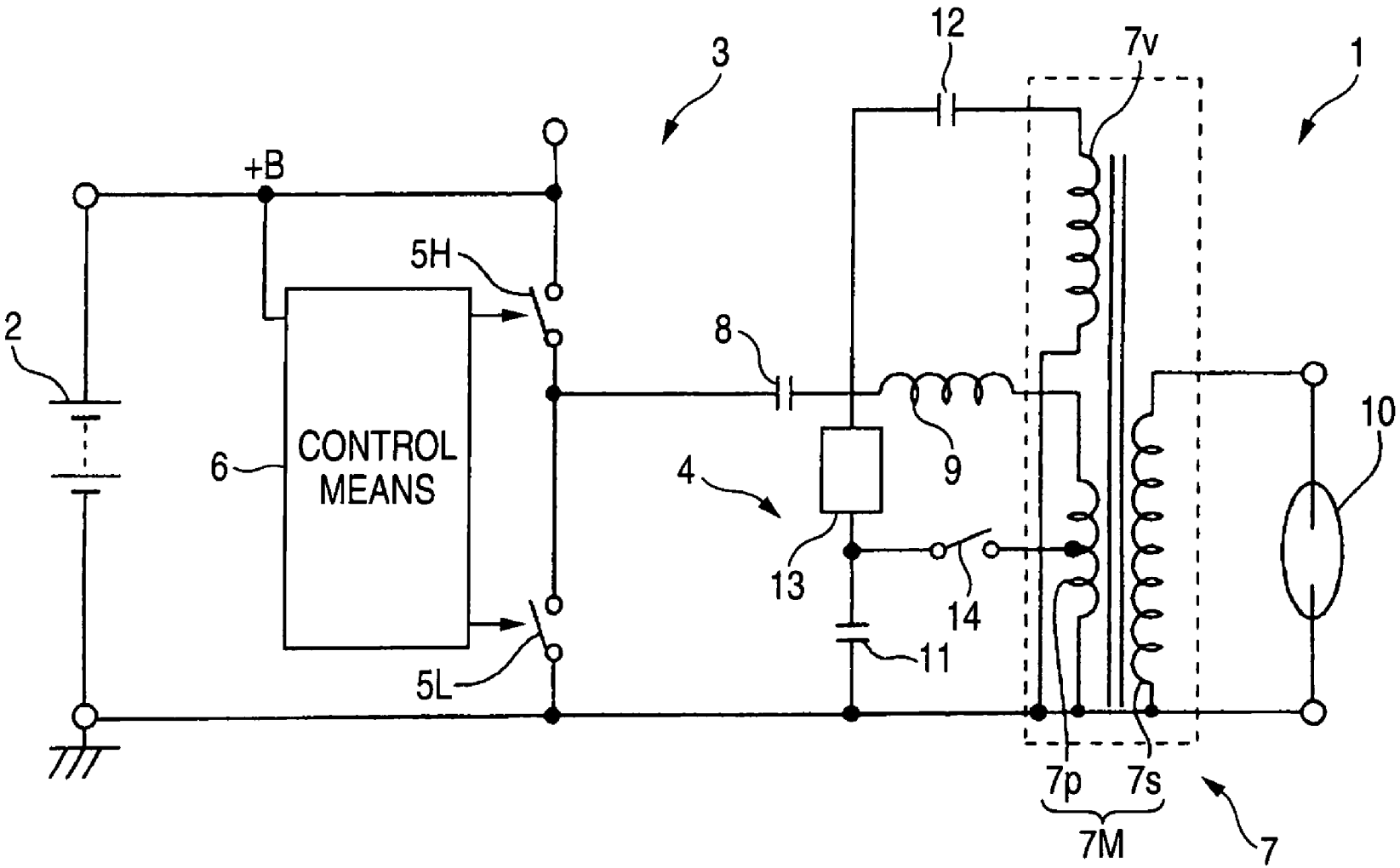
FIG. 1 is a diagram showing an example of a circuit arrangement of a discharge lamp lighting circuit according to the invention.

FIG. 1 shows an arrangement of a discharge lamp charging circuit according to the invention, in which a discharge lamp lighting circuit 1 is provided with a direct current-alternating current converting circuit 3 and a starting circuit 4 which are supplied with power from a direct current power source 2.

The direct current-alternating current converting circuit 3 is for receiving a direct current input voltage (refer to as '+B' in the drawing) from the direct current power source 2 to convert the voltage into an alternating current voltage and boosting the voltage. According to the example, the circuit has two switching elements 5H, 5L and controlling means 6 for controlling the drive for the switching elements. That is, one end of the switching element 5H on a high-stage side is connected to a power source terminal, and the other end of the switching element is grounded by way of the switching element 5L on a low-stage side. Although the elements 5H, 5L are illustrated by signs of switches, a semiconductor switching element of a field effect transistor (FET), bipolar transistor or the like can be used.

The direct current-alternating current converting circuit 3 has a series resonance circuit including an inductance element or a transformer and a capacitor. According to the example, the direct current-alternating current converting circuit 3 includes a transformer 7 for transmitting power. The circuit arrangement uses a resonance phenomenon of a capacitor 8 for resonance, and an inductor or an inductance component. Three possible modes are pointed out below.

(I) A first mode of utilizing resonance of a capacitor 8 for resonance and an inductance element (II) A second mode of utilizing resonance of the capacitor 8 for resonance and a leakage inductance of the transformer 7.

(III) A third mode of utilizing resonance of the capacitor 8 for resonance and an inductance element and a leakage inductance of the transformer 7.

The first mode includes an inductance element 9 of a coil for resonance. For example, one end of the element is connected to the capacitor 8 for resonance, and the capacitor 8 is connected to a connection point of the switching elements 5H and 5L. In addition, an arrangement of connecting the other end of the inductance element 9 to a primary winding 7*p* of the transformer 7 is shown.

According to the second mode, it is not necessary to add a coil or the like for resonance by utilizing an inductance component of the transformer 7. That is, one end of the capacitor 8 may be connected to the connection point of the switching elements 5H and 5L, and the other end of the capacitor 8 may be connected to the primary winding 7*p* of the transformer 7.

In the third mode, a series synthesized reactance of the inductance element 9 and the leakage inductance can be used.

In any of the foregoing modes, when the switching elements are alternately turned ON/OFF by rectifying a driving frequency of the switching elements 5H, 5L to a value equal to or higher than a series resonance frequency by utilizing series resonance of the capacitor 8 for resonance and an inductive element (inductance component or inductance element), a discharge lamp 10 (e.g., a metal halide lamp or the like used in a vehicular lamp piece) connected to a secondary winding 7*s* of the transformer 7 can be turned on. Further, when using the control means 6 to control the drive for the respective switching elements, it is necessary to drive the respective elements inversely such that both of the switching elements are not brought into an ON state (e.g., by controlling on duty or the like). In the following discussion, a resonance frequency before lighting is designated by 'f1,' a resonance frequency in a lighting state is designated by 'f2,' and an electrostatic capacitance of the capacitor 8 for resonance is designated by 'Cr,' an inductance of the inductance element 9 is designated by 'Lr,' and a primary side inductance of the transformer 7 is designated by 'Lp1.' Then, in the third mode (III), before lighting the discharge lamp, the resonance frequency becomes '$f1=1/(2\cdot\pi\cdot\sqrt{(Cr\cdot(Lr+Lp1))})$.' For example, when the drive frequency is lower than f1, the loss of the switching element is increased and the efficiency deteriorates. Therefore, the switching operation is carried out in a frequency range higher than f1. Further, after lighting the discharge lamp, the resonance frequency becomes '$f2\approx1/(2\cdot\pi\cdot\sqrt{(Cr\cdot Lr)})$' ($f1<f2$). Also in this case, the switching operation is carried out in a frequency range higher than f2.

The transformer 7 has a main winding 7M, which includes the primary winding 7*p* and the secondary winding 7*s*, and an auxiliary winding 7*v* for generating a high voltage to generate a starting signal to the discharge lamp 10.

The starting circuit 4 supplies the starting signal to the discharge lamp 10 and includes a first capacitor 11, a second capacitor 12, a circuit portion 13 including a rectifying element (for example, a charge pump type circuit of a double voltage rectifying circuit or the like), and a switching element 14 (illustrated as a switch in the drawing).

The primary side of the transformer 7 includes the first capacitor 11, the circuit portion 13 and the switching element 14. A voltage provided by the auxiliary winding 7*v* is supplied to the circuit portion 13 by way of the second capacitor 12. The switching element 14 is brought into a conductive state when the first capacitor 11 is charged and a terminal voltage of the capacitor exceeds a predetermined threshold. At that time, a signal generated at the primary winding 7*p* of the transformer 7 is boosted by the transformer 7 and is supplied to the discharge lamp 10 (a starting signal is superposed on an output converted into an alternating current voltage to be supplied to the discharge lamp 10). Further, according to the example, one end of the self-break down type switching element 14 is connected to the capacitor 11, and the other end of the element 14 is connected to a middle tap of the primary winding 7*p*.

Although in the example the capacitor 12 is interposed between the auxiliary winding 7*v* and the circuit portion 13, the circuit is not limited to that implementation. Various other modes can incorporate a high voltage generating portion (e.g., including a core and an insulated bobbin) and the capacitor 12 or the like.

In the arrangement of FIG. 1, the transformer 7 serves to transmit power to the discharge lamp 10 and to supply the starting signal to the discharge lamp 10. Power of the discharge lamp 10 is controlled by converting a direct current input into an alternating current voltage and boosting the voltage by the direct current-alternating current converting circuit 3 under the control means 6. In starting the discharge lamp 10, the starting signal is generated based on the voltage supplied from the auxiliary winding 7*v* of the transformer 7 and is supplied to the discharge lamp 10 by way of the main winding 7M of the transformer 7.

Providing a primary voltage necessary for starting the discharge lamp can be achieved, for example, by using an inductance element 9 (e.g., coil for resonance), or the secondary winding 7*s*, according to an arrangement that adds an auxiliary winding to a coil for resonance. In such cases, a core is enlarged and may pose a thermal problem by an increase in loss (because core loss is proportional to core volume). According to the method of using the secondary winding of the transformer, when generating the starting signal, which is composed of a high voltage pulse, the signal is added to the capacitor 11. Such cases may cause attenuation of the pulse.

The foregoing problems can be addressed by adopting the arrangement with the auxiliary winding 7*v* of the transformer 7 so as to provide the voltage necessary for generating the starting signal, and using the capacitor 12.

Figure 2:
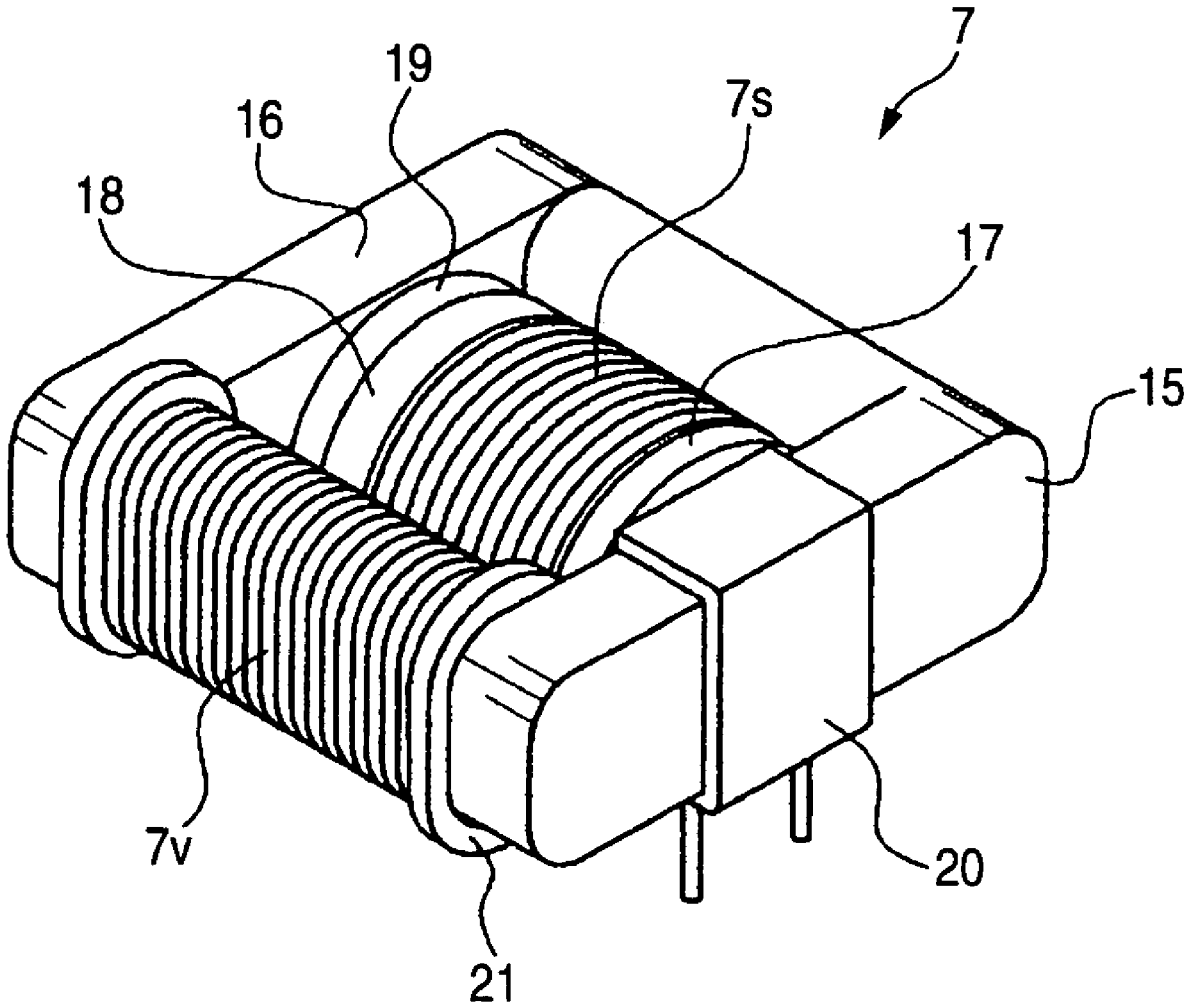
FIG. 2 is a perspective view showing an example of a transformer.

FIG. 2 is a perspective view showing an example of an arrangement of the transformer 7. According to the example, a closed magnetic path type using an E type core and an I type core is used.

In a magnetic core formed by using an E type core 15 and an I type core 16, a middle leg of the E type core 15 is wound with the main winding 7M. (Only the secondary winding 7*s* disposed at its outer periphery is shown in the drawing.) That is, the primary winding 7*p*, a spacer 17, the secondary winding 7*s*, an insulated bobbin 18, and a terminal base 19 that also serves as a spacer, are arranged along a center axis of a core stay (middle leg), and the E type core 15 is attached with a terminal base 20.

According to the example, the primary winding 7*p* is at a surrounding of the middle leg, the insulated bobbin 18 is at a surrounding thereof and the secondary winding 7*s* is wound at an outer periphery of the insulated bobbin 18. Further, in a magnetic circuit using the E type core 15 and the I type core 16, a gap (not shown) is formed between an end portion of the middle leg of the E type core 15 and the I type core 16.

The auxiliary winding 7*v* is wound around a bobbin 21 by using a conductive wire and is arranged at an outer periphery of a core stay separately from the core stay wound with the main winding 7M (i.e., the outer leg in the example). This is for weakening a magnetic coupling with the main winding 7M. That is, when the auxiliary winding 7*v* is arranged by magnetic coupling to the same degree as that of the main winding 7M, a high voltage pulse at the same level as that of the starting signal generated in starting the discharge lamp is induced in the auxiliary winding 7*v*. The pulse is absorbed by the capacitor 11, and an energy necessary for generating the starting signal cannot effectively be utilized. By weakening the magnetic coupling between the main winding 7M and the auxiliary winding 7*v*, such a drawback can be prevented from occurring.

Figure 3:
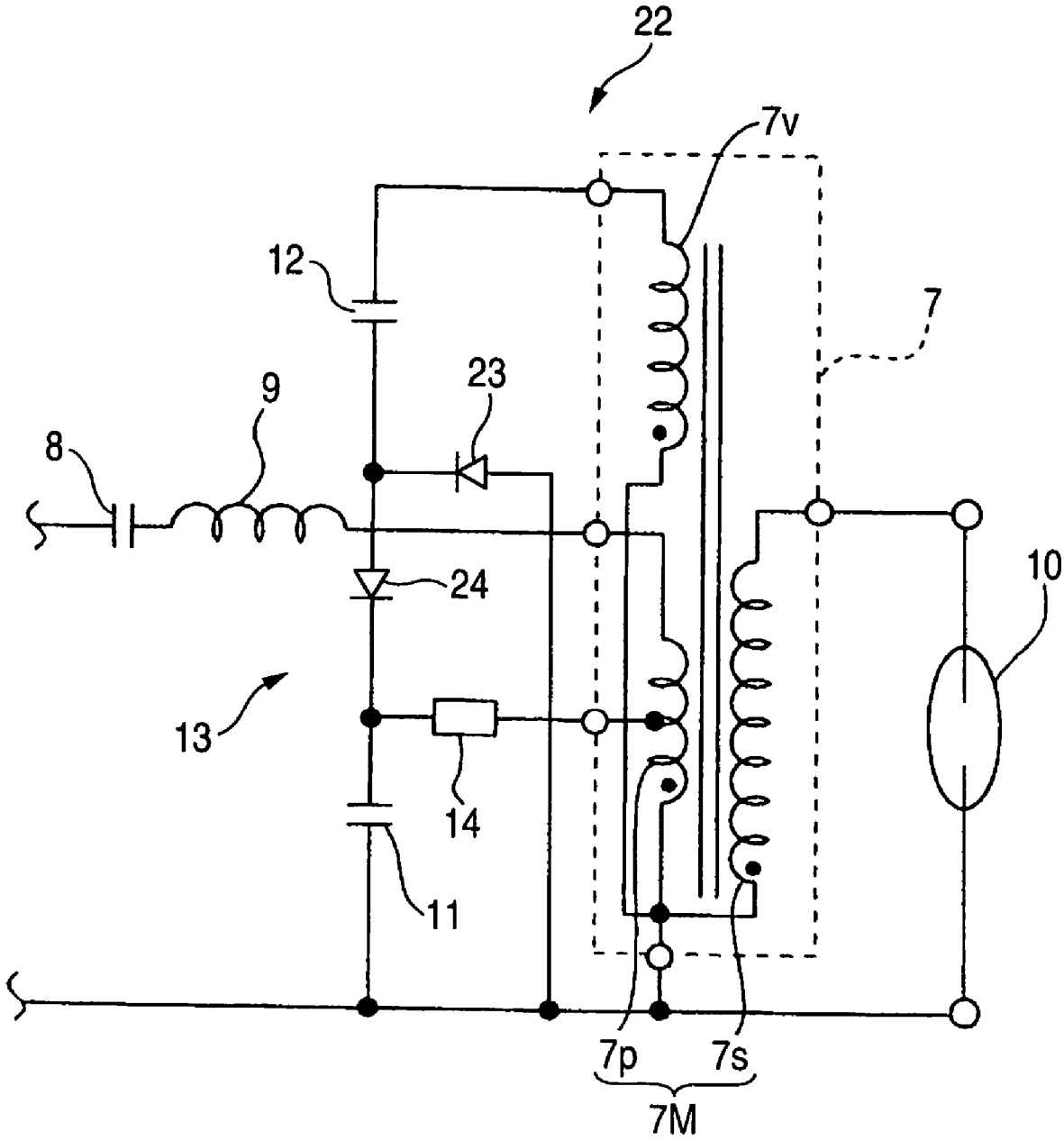
FIG. 3 is a circuit diagram showing an example of a starting circuit.

FIG. 3 illustrates the arrangement of the starting circuit using the transformer 7. In the example 22, the circuit portion 13 is composed of two diodes 23, 24, the starting signal is generated by the starting circuit based on the voltage provided by the auxiliary winding 7*v*, and the voltage is supplied to the discharge lamp 10 by way of the main winding 7M.

One end of the capacitor 11 is connected to the middle tap of the primary winding 7*p* by way of the switching terminal 14 of a self-break down type of a spark gap or the like. Further, the other end of the capacitor 11 is grounded and is connected to one end (i.e., the winding start end) of the primary winding 7*p* and the secondary winding 7*s* of the transformer 7.

An anode of the diode 23 is grounded, a cathode of the diode 23 is connected to an anode of the diode 24 and is connected to the auxiliary winding 7*v* by way of the capacitor 12.

A cathode of the diode 24 is connected to a connection point of the capacitor 11 and the switching element 14.

An operation of charging the capacitor 12 by way of the diode 23 and an operation of charging the capacitor 11 from the capacitor 12 by way of the diode 24 are repeated. The switching element 14 is brought into a conductive state when a terminal voltage of the capacitor 11 exceeds a threshold. As a result, a high voltage pulse is generated and is applied to the discharge lamp 10 after having been boosted by the main winding 7M of the transformer 7.

The capacitor 12 serves to prevent the high voltage induced at the auxiliary winding 7*v* from being applied to the capacitor 11 in generating the high voltage pulse and also serves as an element forming the double voltage rectifying circuit for generating the primary voltage in the starting circuit.

The invention is not limited to the foregoing example. In other implementations, a multi-staged voltage booster circuit can be used in the circuit portion 13.

Figure 4:
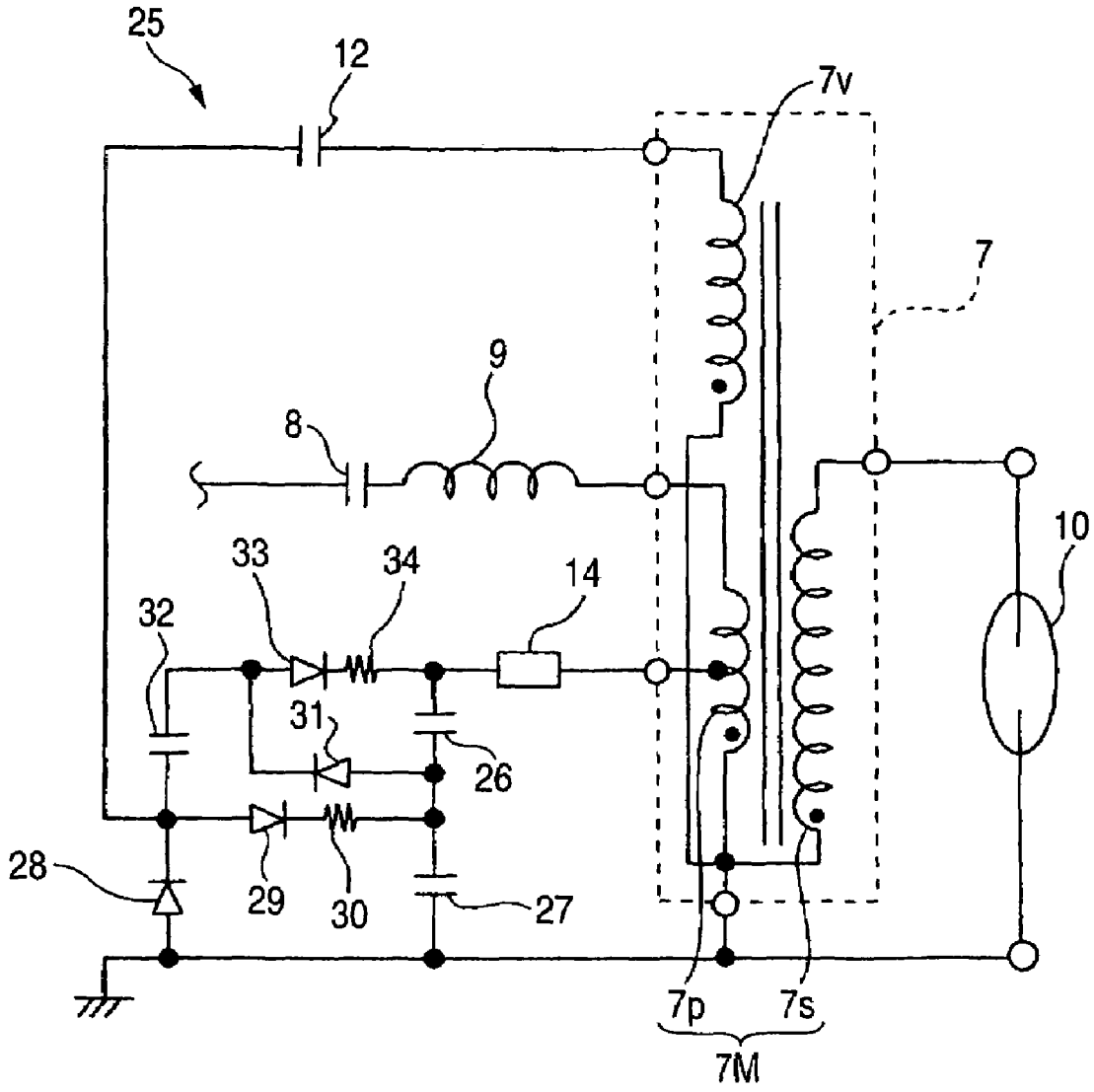
FIG. 4 is a circuit diagram showing another example of a starting circuit.

FIG. 4 is a circuit diagram showing an example 25 of the transformer and the starting circuit.

According to the example, the starter capacitor corresponding to the capacitor 11 is connected by connecting capacitors 26, 27 in series. A double voltage rectifying circuit is formed by the capacitors along with a rectifying element (e.g., diode).

The double voltage rectifying circuit includes a diode 28 and the capacitor 12. An anode of the diode 28 is grounded, and a cathode of the diode 28 is connected to one end of the auxiliary winding 7*v* by way of the capacitor 12. Further, the other end of the auxiliary winding 7*v* is grounded and is wound around the core with a polarity such that a surge voltage induced in generating the starting signal applied to the discharge lamp 10 becomes a negative potential relative to a ground potential.

An anode of a diode 29 is connected to the cathode of the diode 28 such that the capacitor 27 is charged from the double voltage rectifying circuit (28, 12) by way of the diode 29 and a resistor 30. A cathode of the diode 29 is connected to one end of the capacitor 27 by way of the resistor 30. The other end of the capacitor 27 is grounded.

The capacitor 26 is connected in series with the capacitor 27, and one end of the capacitor 26 is connected to the switching element 14. A self-break down type element of a spark gap or the like is used for the switching element 14.

An anode of a diode 31 is connected between the capacitors 26, 27, and a cathode of the diode is connected to one end of a capacitor 32.

A terminal of the capacitor 32, which is not connected to the diode 31, is connected to the cathode of the diode 28 and the anode of the diode 29.

An anode of the diode 33 is connected to one end of the capacitor 32 such that electric charge stored in the capacitor 32 is transmitted to the capacitor 26 by way of the diode 33 and a resistor 34. A cathode of the diode 33 is connected between the capacitor 26 and the switching element 14 by way of the resistor 34.

one end of the capacitor 26 is connected to the middle tap of the primary winding 7*p* by way of the switching element 14.

FIG. 5 through FIG. 8 show flows of transmitting electric charge of the respective capacitors in the circuit of FIG. 4.

By using the auxiliary winding 7*v* of the transformer 7, an alternating current voltage of a high voltage that oscillates positively and negatively is generated at a connection point of the diode 28 and the capacitor 32. The connection point is indicated by "P" in the drawing. Thus, alternating current voltage serving as a reference by the ground potential is supplied to the double voltage rectifying circuit at a later stage, as shown below, and the capacitors 26, 27 are charged by transmitting electric charge at respective time periods of a positive half-wave and a negative half-wave related to the alternating current voltage.

Figure 5:
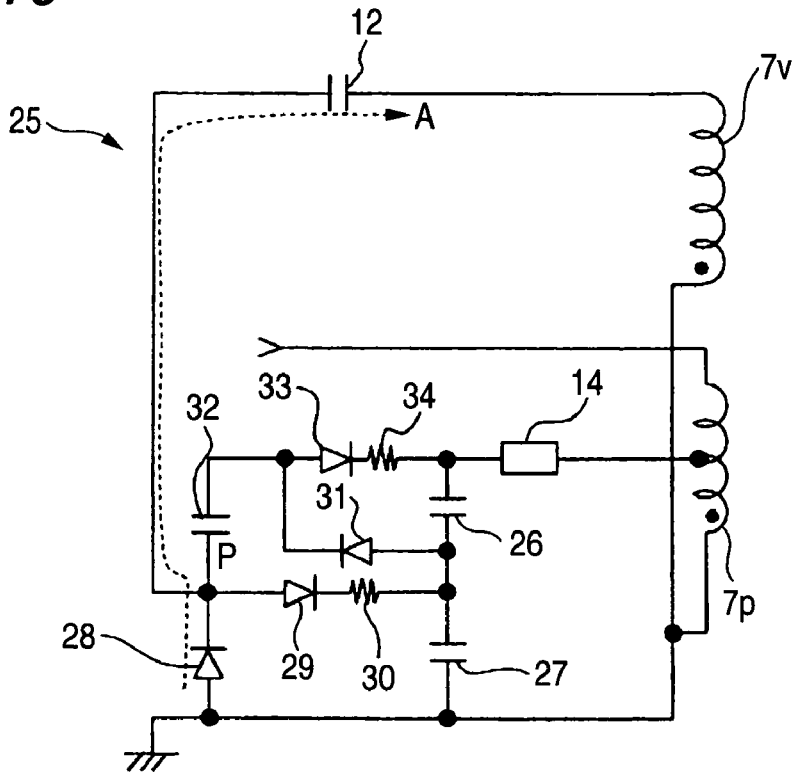
FIG. 5 is a diagram for explaining electric charge transmission in the circuit of FIG. 4, along with FIG. 6 through FIG. 8. The diagram is an explanatory diagram showing a path for charging a capacitor.

At a half period (negative half-wave), a current flows from the diode 28 to the capacitor 12, as shown by an arrow "A" in FIG. 5.

Figure 6:
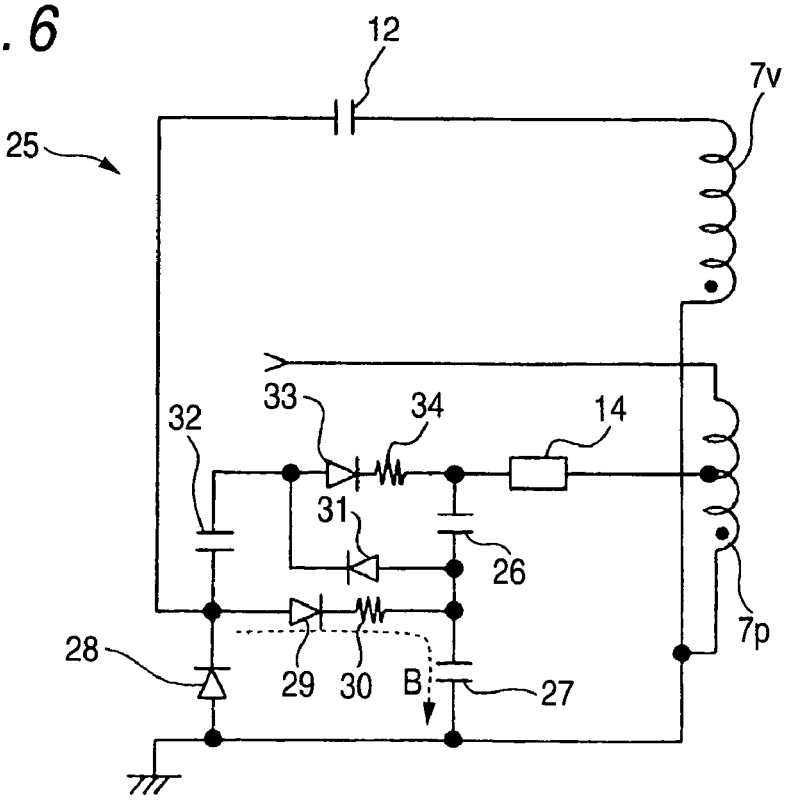
FIG. 6 is an explanatory diagram showing a path for charging of a capacitor.

At the next positive half-wave, in FIG. 6, as shown by an arrow mark "B" in the drawing, electric charge is stored in the capacitor 27 by way of the diode and the resistor 30 along a forward direction of the diode 29.

Figure 7:
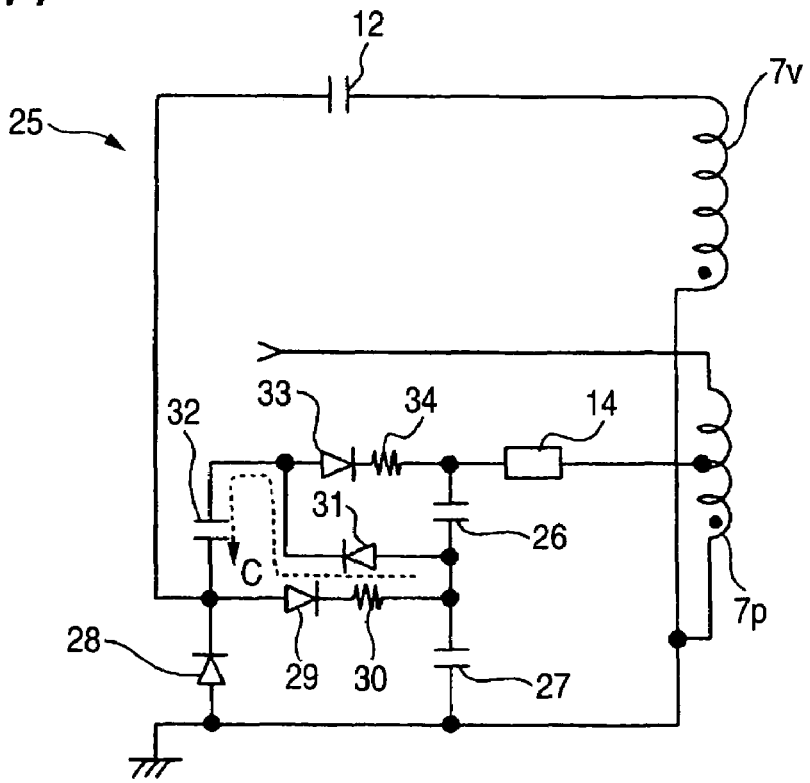
FIG. 7 is an explanatory diagram showing a path of charging for a capacitor.

In FIG. 7, at a next half wave related to the alternating current voltage, as shown by an arrow mark "C," electric charge is stored by the capacitor 32. That is, the double voltage rectifying circuit is formed by the capacitor 32 and the diode 31.

Figure 8:
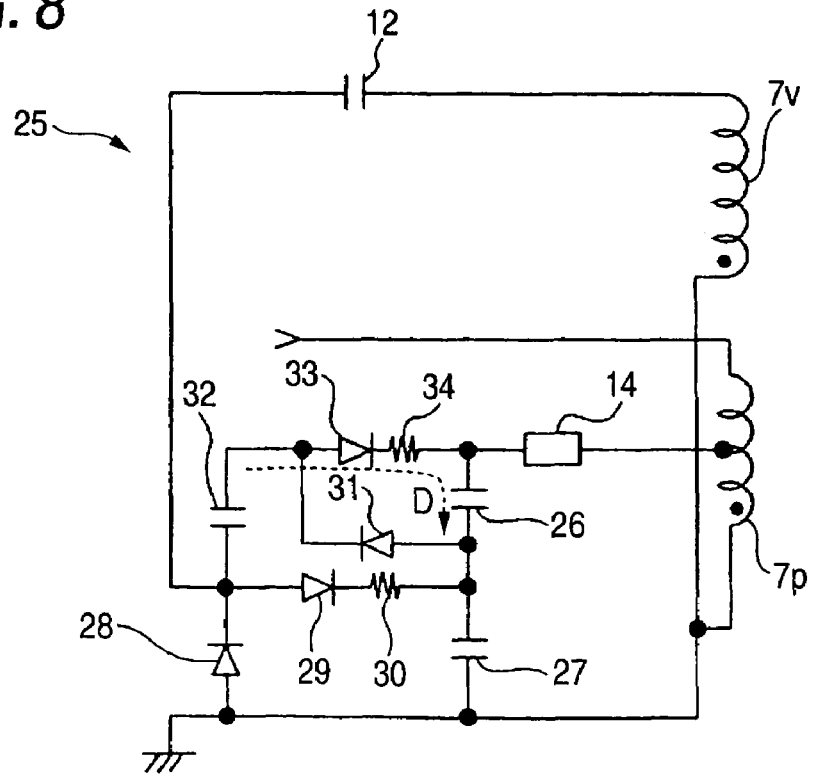
FIG. 8 is an explanatory diagram showing a path for charging of a capacitor.

Further, at a next half period, as shown by an arrow mark "D" in FIG. 8, electric charge is stored in the capacitor 26 along a forward direction of the diode 33 by way of the diode and the resistor 34.

Electrostatic capacitances of the capacitors 26 and 27 are made to be equal, in accordance with the above-described transmittance of electric charge, a voltage that doubles the voltage generated by the double voltage rectifying circuit (28, 12) is generated in the capacitors. Thus, the voltage rises by four times as much as the voltage of the auxiliary winding 7*v*.

When the voltage generated to the capacitors 26 and 27 exceeds a threshold, the switching element 14 is brought into the conductive state to generate the starting signal. That is, the signal generated at the primary winding 7*p* of the transformer 7 is applied to the discharge lamp 10 after having been boosted by the transformer.

In the foregoing arrangement, the capacitor 12 serves to prevent absorption of energy (and, therefore, also attenuation of the pulse) by the capacitors 26 and 27 in generating the starting pulse. That is, the auxiliary winding 7*v* for generating the high voltage is magnetically coupled with the main winding 7M although the voltage is weak as described above. Therefore, when the high voltage pulse constituting the starting signal is generated, the surge voltage is generated at the auxiliary winding 7*v* in accordance with the pulse generation. As the energy is deprived from the capacitors 26 and 27, it amounts to attenuation of the starting signal and, therefore, the capacitor 12 prevents such a drawback. Furthermore, an electrostatic capacitance of the capacitor 12 is sufficiently large to be capable of sufficiently charging the capacitors 26 and 27 relative to the frequency of the alternating current voltage within a predetermined time period (i.e., the time period preferable for conducting the switching element 14, which may be set to about several milliseconds through several tens of milliseconds). However, in order to prevent or reduce attenuation of the starting signal, it is preferable to set the capacitance as small as possible.

To establish the potential of the capacitor 12 in generating the surge voltage, the diode 28 is interposed and the anode is grounded, and the auxiliary winding 7*v* is wound with the polarity by which the surge voltage induced in generating the starting signal has a negative potential relative to the ground potential.

It is preferable to use laminated ceramic capacitors of a paraelectric material for the capacitors 26, 27 that form the starter capacitor, to obtain a small-sized circuit. That is, although a dielectric material used in the laminated ceramics capacitor is classified into a ferroelectric material and a paraelectric material, in the case of the ferroelectric material, a reduction in the electrostatic capacitance by charging and a piezoelectric effect may occur and, therefore, it is preferable to use the paraelectric material.

To ensure the required capacitance with as few capacitive elements as possible, it may be preferred to use capacitors having a low withstanding voltage and a large capacitance connected in series. The withstanding voltage of the laminated ceramics capacitor is determined by a distance between inner electrodes; thus, the longer the distance between the electrodes, the larger the withstanding voltage. On the other hand, the electrostatic capacitance is reduced. An outer thickness of the capacitor is determined by standards, in a case of ensuring a necessary electrostatic capacitance, by connecting capacitors having low withstanding voltage and large capacitance, a number of pieces thereof is smaller (because when an inner portion of one piece of the capacitor is considered, when the withstanding voltage is low, the capacitance per one layer of the inner electrode is increased and the number of lamination can conversely be increased).

In the foregoing circuit in which two capacitors 26, 27 are connected in series, the respective capacitors also serve as capacitors of the double voltage rectifying circuit. Thus, the voltage is four times as much as the voltage of the auxiliary winding 7*v* is boosted and, therefore, the number of turns of the auxiliary winding 7*v* can be reduced, which contributes to small-sized formation of the transformer 7. Further, by limiting the surge voltage in generating the starting pulse, a withstanding voltage is reduced, which can be effective for reducing cost.

Various advantages, some of which are listed below, may be achieved.

By providing the capacitor 12, absorption of energy by the capacitors 26, 27 can be prevented when generating the starting signal. Furthermore, the double voltage rectifying circuit can be formed by using the capacitor.

By supplying the alternating current voltage changed positively and negatively by forming the reference by the ground potential to the double voltage rectifying circuit, the circuit can be formed by a comparatively small number of parts The auxiliary winding is wound with a polarity by which the surge voltage generated in the auxiliary winding in generating the starting signal becomes a negative potential relative to the ground potential, and the potential of the capacitor 12 on the side of the diode is fixed to the ground by operation of the diode 28. Thus, it is guaranteed that the terminal of the capacitor 12 on the side of the auxiliary winding 7*v* is not applied with a voltage equal to or higher than the surge voltage by the auxiliary winding. As a result, the withstanding voltage of the capacitor 12 can be minimized, which is effective for reducing cost. Further, the anode potential of the diode 29 in generating the starting signal is fixed by operation of the diode 28 and, therefore, the surge withstand amount of the resistor 30 can be limited.

In the mode of connecting the laminated ceramics capacitors having low withstanding voltage and large capacity, the necessary electrostatic capacitance can be ensured with a minimum number of pieces of capacitors.

By electric charge transmission of the charge pump type using the capacitor and the diode, the turn number of the auxiliary winding is reduced by boosting the voltage by four times, which contributes to small-sized formation of the transformer.

What is claimed is:

1. A discharge lamp lighting circuit comprising:

a transformer for transmitting power to a discharge lamp and for supplying a starting signal to the discharge lamp;

a direct current-alternating current converting circuit for supplying an output of the transformer to the discharge lamp by receiving a direct current input voltage and converting the direct current input voltage into an alternating current voltage; and a starting circuit for applying the starting signal to the discharge lamp, wherein a primary side of the transformer has a first capacitor, a circuit portion including a rectifying element, and a switching element, and when a terminal voltage of the first capacitor rises and the switching element is brought into a conductive state, a signal generated at a primary winding of the transformer is applied to the discharge lamp as the starting signal after having been boosted by the transformer; and wherein the transformer has an auxiliary winding for supplying a voltage for generating the starting signal to the starting circuit, and wherein a second capacitor is interposed between the auxiliary winding and the circuit portion.

2. The discharge lamp lighting circuit according to claim 1, wherein the auxiliary winding has a polarity such that, during operation, a surge voltage induced in generating the starting signal becomes a negative potential;

wherein one end of the rectifying element constituting the circuit portion is grounded and another end of the rectifying element is connected to the second capacitor.

3. The discharge lamp lighting circuit according to claim 1, wherein the first capacitor comprises capacitors in series and wherein the respective capacitors and the rectifying element form a double voltage rectifying circuit.

4. The discharge lamp lighting circuit according to claim 3, adapted so that, during operation, an alternating current voltage that serves as a reference with respect to a ground potential is supplied to the double voltage rectifying circuit, and wherein the first capacitor is charged by transmitting, at respective time periods, an electric charge of a positive half-wave and a negative half-wave related to the alternating current voltage.

5. The discharge lamp lighting circuit according to claim 3, wherein the capacitors comprise a laminated ceramic capacitor of a paraelectric material.

* * * * *